United States Patent [19]

Hodgkins et al.

[11] Patent Number: 4,862,838

[45] Date of Patent: Sep. 5, 1989

[54] CRANKCASE OIL SPRAY NOZZLE FOR PISTON COOLING

[75] Inventors: David H. Hodgkins, Granby; Leon P. Janik, Suffield, both of Conn.

[73] Assignee: Stanadyne Automotive Corp., Windsor, Conn.

[21] Appl. No.: 245,502

[22] Filed: Sep. 19, 1988

Related U.S. Application Data

[63] Continuation-in-part of Ser. No. 203,439, Jun. 7, 1988, abandoned.

[51] Int. Cl.[4] ..... F01P 3/08

[52] U.S. Cl. ..... 123/41.35; 239/555; 184/6.26; 29/513

[58] Field of Search ..... 123/41.35; 239/555; 29/157 R, 157 L, 157.1, 513; 184/6.26

[56] References Cited

U.S. PATENT DOCUMENTS

| | | | |
|---|---|---|---|
| 2,800,119 | 7/1957 | Schmidl | 123/41.35 |
| 3,615,054 | 10/1971 | Botz | 239/555 |
| 3,937,109 | 2/1976 | Korner et al. | 29/513 |
| 4,602,413 | 7/1986 | Krauss et al. | 29/157.1 R |

*Primary Examiner*—Noah P. Kamen

*Attorney, Agent, or Firm*—Chilton, Alix & Van Kirk

[57] ABSTRACT

A crankcase oil spray nozzle for cooling the crown of a piston of an internal combustion engine is assembled from relatively few stamped principal housing components which are assembled in a sandwich-like, low-profile configuration. The components cooperate to form a nozzle passageway which extends from an integrally formed well to the nozzle orifice. The well houses a check valve assembly. The nozzle components cooperate to define an internal edge filter.

20 Claims, 9 Drawing Sheets

44
60
42
62
30
31
39
56
59
50
40
4
4
46'
46
46''
10

38
30
40
50
36
39
37

CRANKCASE OIL SPRAY NOZZLE FOR PISTON COOLING

CROSS REFERENCE TO RELATED APPLICATION

This application is a continuation-in part, of application Ser. No. 203,439 filed on June 7, 1988, now abandoned.

BACKGROUND OF THE INVENTION

This invention relates generally to devices and systems for cooling the pistons in internal combustion engines. More particularly, this invention relates generally to crankcase oil spray nozzles employed for cooling pistons.

Internal combustion engines and in particular diesel engines employ oil and lubrication systems to cool or remove heat from the area of the piston and cylinder. In one conventional cooling system, tubular nozzles extend at the interior of the engine crankcase and are oriented to direct a spray of oil at the underside of the piston crown. The tubular nozzles communicate with the oil supply gallery. A check valve in the nozzle selectively prevents the spray of oil from the nozzle until the oil pressure exceeds a pre-established threshold. An oil spray nozzle is located in each of the engine cylinders.

SUMMARY OF THE INVENTION

Briefly stated, the invention in a preferred form is a crankcase oil spray nozzle for cooling a piston in an internal combustion engine. The oil spray nozzle has an efficient low cost sandwich-type construction which permits installation in the engine crankcase in an efficient manner. The oil spray nozzle in some embodiments incorporates an internal filter system to insure reliable operation.

In one embodiment, a housing member forms a transversely protruding inlet well which defines an inlet opening intermediate a nozzle end and an opposing second end of the housing member. The housing member also comprises a pair of laterally spaced sidewalls. A cover plate is received between the sidewalls and secured to the housing member by folded extensions of the sidewalls. The cover plate cooperates with the housing member to define a nozzle passageway which extends from the well to a nozzle orifice at the nozzle end. A check valve comprising a valve member and a spring is received in the well and captured between the housing member and the cover plate. The valve member is biased by the spring to prevent the passage of fluid through the passageway when the pressure of the fluid is below a pre-established threshold. The valve member is displaceable to permit the passage of fluid for injection through the nozzle orifice.

An intermediate plate may be disposed between the housing member and the cover plate in a sandwich-like fashion. The intermediate plate, the housing member, and the cover plate define the nozzle passageway. The spring may be employed as a filter to the passage fluid between the inlet opening and the nozzle orifice. The housing member and the cover plate may also have an array of projections which cooperate to define an internal edge filter in the nozzle passageway.

In one embodiment, a leaf spring is anchored at one end between the housing member and the cover plate to interrupt the passage of fluid through the nozzle when the fluid is below a pre-established threshold. The cover plate has an arcuate cross section and the housing member has a planar portion which cooperate to define the fluid passageway of the nozzle. The cover plate has a terminus which is rounded to define a deflector adjacent to the nozzle orifice.

An object of the invention is to provide a new and improved oil spray nozzle for cooling the piston of an internal combustion engine by emitting a spray of lubricant and directing the spray at the underside crown of the piston.

Another object of the invention is to provide a new and improved crankcase oil spray nozzle of efficient and low cost construction.

A further object of the invention is to provide a new and improved crankcase oil spray nozzle of compact, low-profile form to allow sufficient clearance between the swing path of the piston connector rod and the nozzle.

A yet further object of the invention is to provide a new and improved crankcase oil spray nozzle which operates in an efficient manner and incorporates a relatively inexpensive integral filter system to prevent the spray orifice from being plugged.

Other objects and advantages will become apparent from the drawings and the specification.

DETAILED DESCRIPTION OF THE INVENTION

Figure 1:
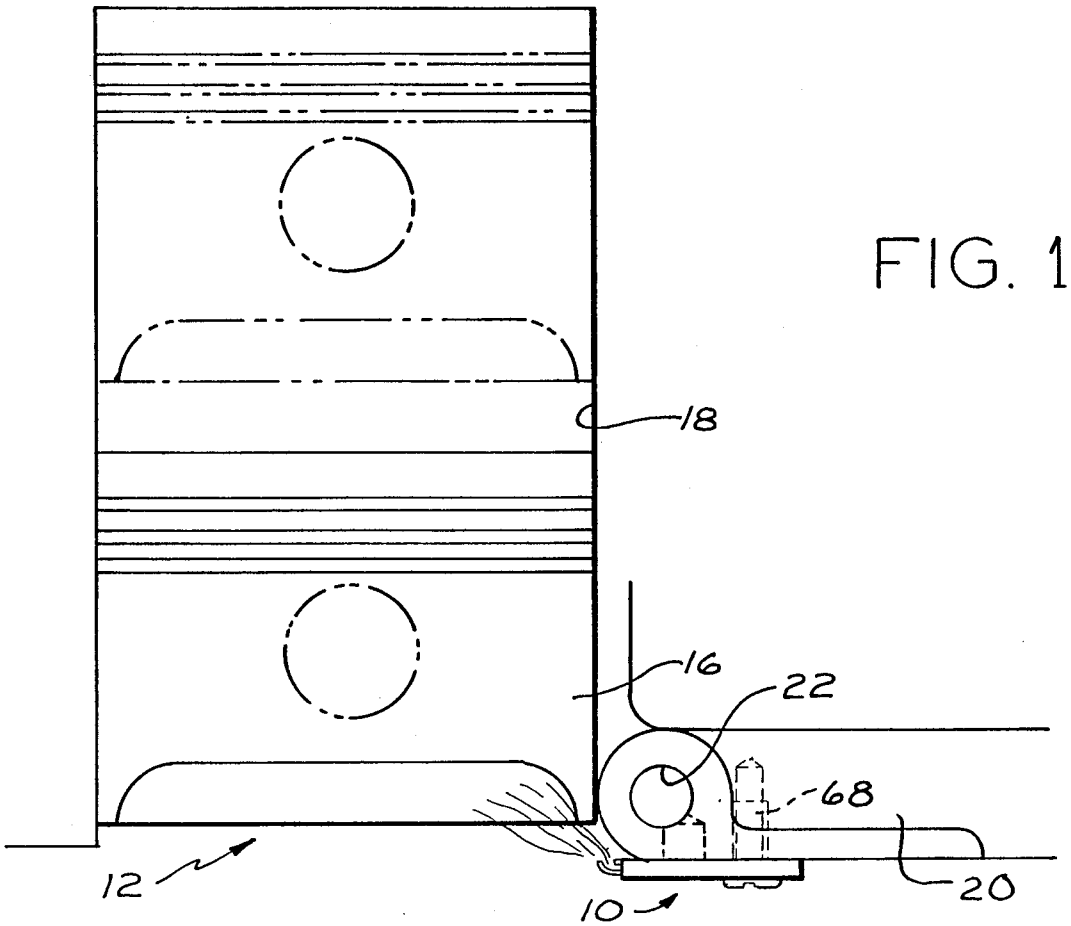
FIG. 1 is an interior fragmentary view, partly in schematic and partly in section, of an engine crankcase illustrating a cylinder and piston and an associated cooling nozzle in accordance with the present invention.

With reference to the drawings wherein like numerals represent like parts throughout the several figures, an oil spray nozzle in accordance with the present invention is generally designated by the numeral 10 in FIG. 1. Oil spray nozzle 10 is employed in an internal combustion engine 12 and oriented for spraying the underside crown of a piston 16 of a given cylinder 18. The oil spray nozzle 10 is mounted interiorly of the engine crankcase 20 and fluidically communicates with the oil supply passage or gallery 22 of the crankcase for supplying oil under pressure. When the oil pressure exceeds a pre-established threshold pressure, pressurized oil traverses through the nozzle 10 for injection or spraying at the underside crown of the piston. The nozzle thus functions to cool the piston crown during engine operation. Connecting rods and other engine components have been omitted from FIG. 1 to better illustrate the invention. The location and the low-profile dimensions of the nozzle are selected to provide clearance with the operational path of the connecting rod and the counter weight. It should be appreciated that a piston cooling nozzle 10 is preferably provided for each corresponding piston of the engine.

Figure 2:
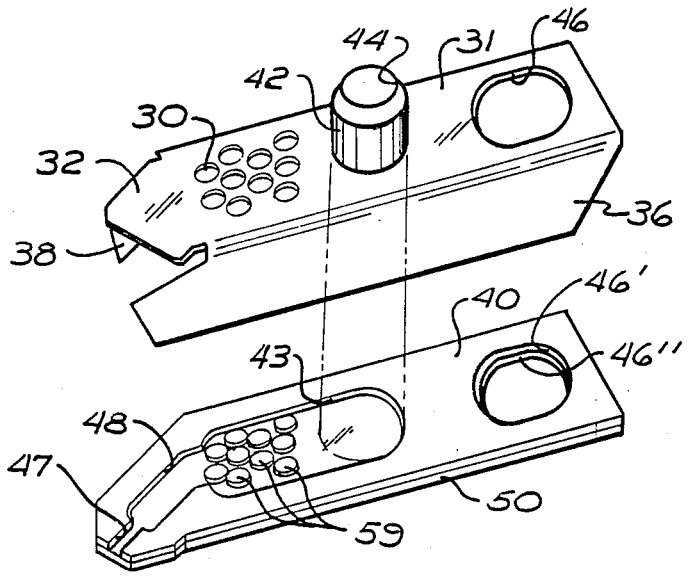
FIG. 2 is an enlarged exploded view of the piston cooling nozzle of FIG. 1 illustrated in a pre-assembled stage.
Figure 3:
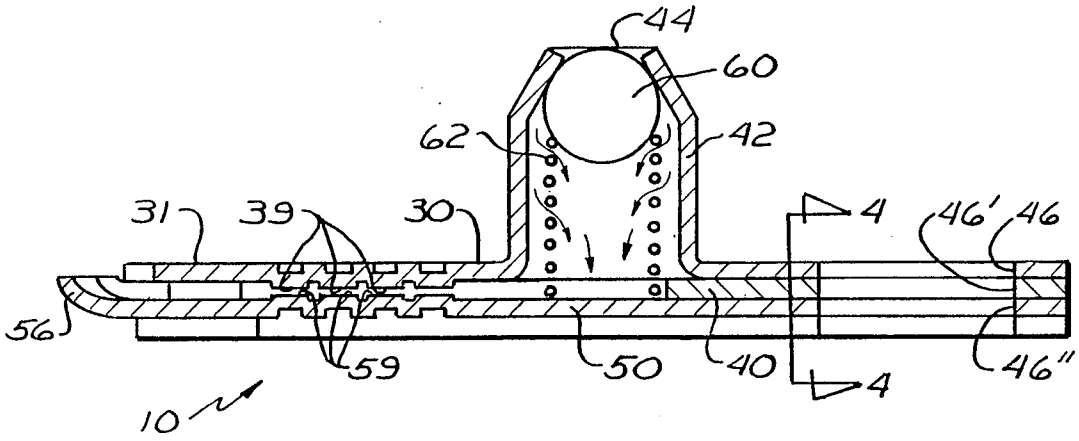
FIG. 3 is an enlarged longitudinal sectional view of the piston cooling nozzle of FIG. 2.
Figure 4:
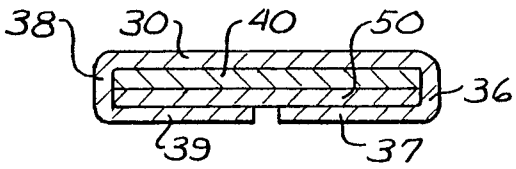
FIG. 4 is a sectional view of the piston cooling nozzle taken along the line 4—4 of FIG. 3.

With additional reference to FIGS. 2–4, the oil spray nozzle 10 in one embodiment has a sandwich-type assembled configuration formed from stamped components. The oil spray nozzle 10 comprises a three-component sandwich-type, main body structure including a housing 30, an intermediate passage plate 40 and a cover plate 50. Each of the three components may be stamped or formed from metallic material The housing 30 generally defines the exterior profile of the nozzle and also functions to provide structure for securing the nozzle components in assembled relationship. The housing is initially stamped from a plate in a multi-surface shape having a nose-like end tab 32, and a pair of laterally spaced creased skirts 36 and 38 which form sidewalls and securing flanges as will be hereinafter described in detail. An integrally extending well 42 is centrally formed in the plate so as to protrude from a planar plate 31 portion of the stamped housing. The well 42 has a generally cylindrical shape with a tapered terminus which defines an inlet opening 44 for the nozzle. An aperture 46 is punched or otherwise formed in the base plate 31 equidistantly between skirts 36 and 38 and longitudinally spaced from well 44.

The base plate 31 extending between the skirts 36 and 38 essentially functions as a receiving tray for the generally planar intermediate passage plate 40. Passage plate 40 is generally planar and has a peripheral shape similar to the base plate 31 of the housing. Passage plate 40 is interiorly received by the housing and abuts against the base plate 31 in surface-to-surface relationship. The intermediate passage plate 40 has a cutout portion defining a well opening 43 and a nozzle passageway 48 leading from the opening 43 to a narrow nozzle orifice 47 formed at the forward end of the passage plate 40. The well opening 43 generally aligns with the well 42 formed in the housing. The nozzle passageway 48 extends generally from the well and obliquely angles toward the nozzle orifice 47. The passage 48 is reduced or tapered at the outlet end to form the nozzle orifice 47. The intermediate plate has a nose-like terminus which generally conforms to the shape of the nose end of the housing base plate 31. An aperture 46', substantially similar in size and shape to aperture 46 is also stamped or formed in plate 40. The dimensions of the well opening 43, nozzle orifice 47 and passageway 48 may be precisely defined by the interior edges of the intermediate plate 40.

The cover plate 50 is generally planar and has a peripheral shape substantially similar to that of the intermediate plate 40. The cover plate 50 also has an aperture 46' which is dimensioned to be substantially similar to that of apertures 46 and 46' and generally alignable therewith. The cover plate 50 engages against the intermediate plate 40 which, in turn, engages against the base plate 30 in a generally tri-layered surface-to-surface relationship. The skirts 36 and 38 are bent over so as to engage against the cover plate 50 to form integral retaining flanges 37 and 39, respectively, to secure the three plates in a sandwich type-configuration. The nose end of the cover plate 50 extends beyond the corresponding nose portion of the housing. The terminus of the cover plate nose portion and a corresponding small portion of the passage plate nose is curved and/or angled so as to form a nozzle opening deflector 56 for deflecting and directing the spray toward the piston crown. The shape of the deflector 56 is selected to provide the desired spray pattern for a given crankcase/piston configuration. The cover plate, intermediate plate and housing cooperate to define an interior nozzle passage which is substantially fluid tight so that a fluid passageway extends from the inlet opening 44 through the nozzle orifice 47. The preferred application of the nozzle as a piston cooler does not require that the nozzle passageway and fluid flow path through the nozzle be hermetically sealed.

A check valve assembly comprising a ball valve 60 and a spring 62 are received in the well 42 and captured between the housing 30 and the cover plate 50. The ball valve 60 is biased to seat against an interior seat proximate to the well terminus to cover the inlet opening 44. After inserting the valve 60 and spring 62 into the well 42, the sidewalls 36 and 38 are bent around both the intermediate plate and the cover plate to enclose and retain the check valve assembly comprising the ball valve 60 and the biasing spring 62. The check valve assembly functions to close the inlet opening to the passage of pressurized oil until the oil exceeds a pre-established pressure threshold, at which time the oil communicates through the inlet 44 and the formed nozzle passage 48 for spray injection through the nozzle orifice 47. The pressure threshold is defined by the force of spring 62.

The substantially identical circular apertures 46, 46', and 46' which are punched or otherwise formed in the base plate, intermediate plate and cover plate align to define a fastener opening transversely extending through the flattened sandwich-type nozzle body. The nozzle 10 is thus easily mounted at the crankcase interior by means of a conventional fastener 68. The nose end portions of the intermediate passage plate and the cover plate are slightly bent to provide the correct orientation of the nozzle relative to the piston crown.

Figure 5:
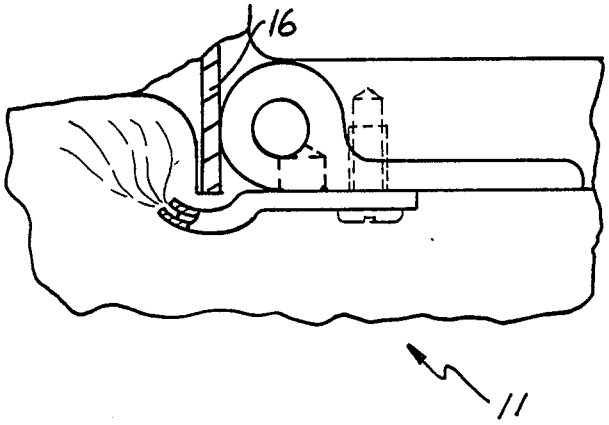
FIG. 5 is a fragmentary sectional view, partly broken away and partly in phantom, illustrating a portion of an engine and a second embodiment of an associated cooling nozzle in accordance with the present invention.
Figure 6:
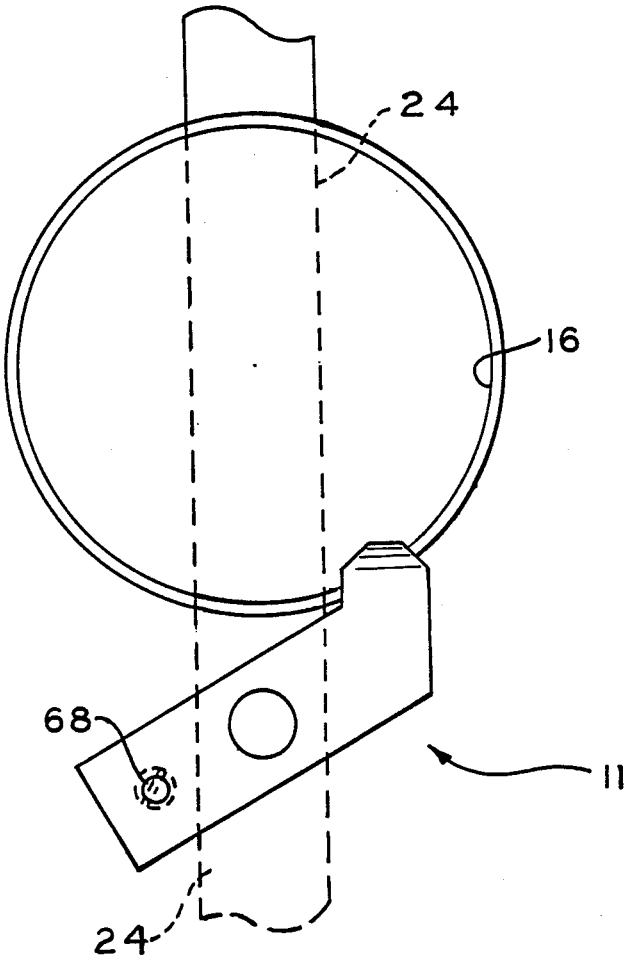
FIG. 6 is a fragmentary interior underside view of the engine and nozzle of FIG. 5 with the swing path of the piston connecting rod being illustrated in broken lines.

A modified embodiment of a piston cooling nozzle 11 is illustrated in FIGS. 5 and 6. Nozzle 11 is substantially identical in form and function to nozzle 10 except for the modifications described herein. The low profile construction allows for the outlet end of the nozzle 11 to be curved or bent away from the engine block when mounted so as to accommodate the end of the piston skirt, at the extreme piston travel position. In addition, the nozzle housing may have a pronounced bent-leg-type shape to provide sufficient clearance between the nozzle outlet and the piston connecting rod. The swing path of the piston connecting rod is denoted by numeral 24 in FIG. 6.

Figure 7:
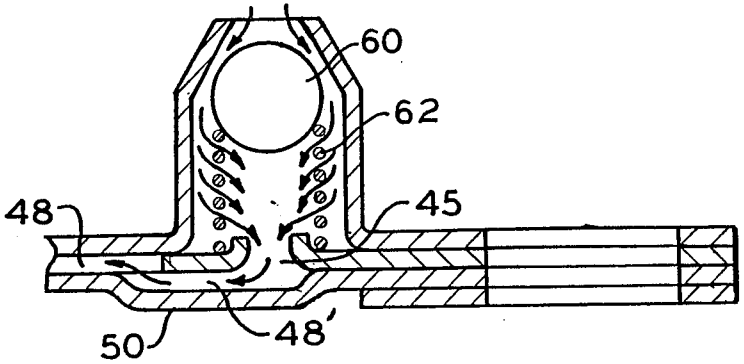
FIG. 7 is a fragmentary longitudinal sectional view of a third embodiment of a piston cooling nozzle in accordance with the present invention.

With reference to FIG. 7, the spring 62 may be configured to essentially function as an auxiliary filter. The spring 62 is configured to permit the passage of oil from the radial exterior to the central interior, as schematically illustrated by the flow path arrows. The spacings between the coils of the spring are dimensioned to prevent the passage of particulate manner. The walls defining the intermediate plate opening 45 are bent to form an upstanding shoulder for seating the end coil of the spring 62. A passageway 48' is defined by a contoured indented portion of the cover plate to form a fluid path from opening 45 through passageways 48' and 48 through the nozzle orifice 47.

Another filter system for the nozzle 10 is illustrated in FIG. 2 and 3. Interior opposing surfaces of the housing base plate 30 and the cover plate 50 are configured with opposing arrays of stamped dimples 39 and 59, respectively, which cooperate to form an interior edge filter of the nozzle for filtering and preventing particulate matter from being deposited or lodged in the nozzle orifice 47. If particulate matter becomes lodged in the nozzle orifice, the spray characteristics of the nozzle could be dramatically altered. In some circumstances, the nozzle orifice could be entirely closed by particular matter. The spacing between the opposing faces of dimples 39 and 59 is dimensioned to provide the restricted passageway.

Figure 13:
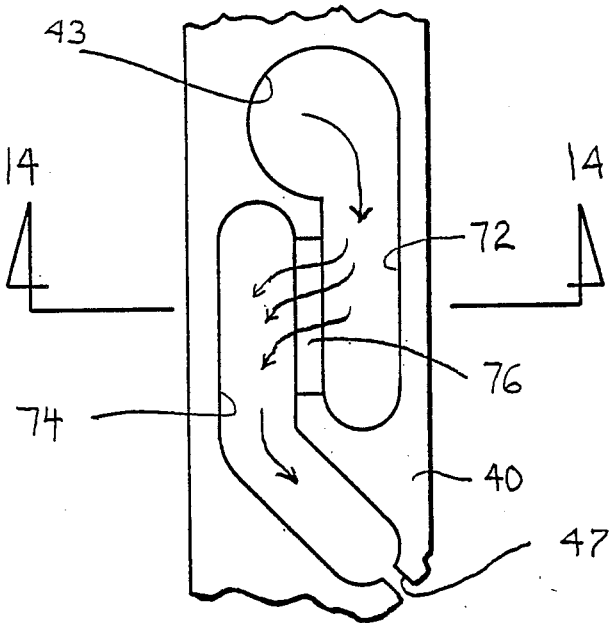
FIG. 13 is an enlarged fragmentary interior bottom view illustrating a filtering system employed in a piston cooling nozzle in accordance with the present invention.
Figure 14:
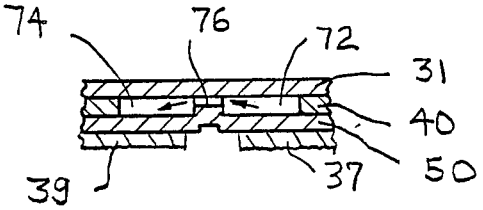
FIG. 14 is a fragmentary sectional view of the piston cooling nozzle taken along the line 14—14 of FIG. 13.

Another internal edge filtering system which may be incorporated into the nozzle 10 is illustrated in FIGS. 13 and 14. The passageway from the inlet opening to the nozzle orifice 47 has a pair of laterally offset, longitudinally extending passage segments 72 and 74. The passage segments 72 and 74 are separated by a ridge 76. The oil flow path to the nozzle orifice (denoted generally by the arrows) essentially crosses the ridge 76 through the gap between the ridge and the housing base plate 31. The clearance between the top surface of the ridge 76 and the underside of the base plate 31 is dimensioned to prevent particulate matter having a diameter greater than the clearance from traversing across the ridge. The ridge thus functions as an edge filter. It should be appreciated that the ridge may cooperate to form a gap between either the base plate or the cover plate.

With reference to FIGS. 8 through 11, another embodiment of a piston cooling nozzle in accordance with the present invention is generally designated by the numeral 90. Piston cooling nozzle 90 differs from the previously described oil spray nozzle 10 principally with respect to the body construction which is essentially stamped and shaped from two plates to form a housing base 92 and a cover 94. The base 92 includes integrally extending tabs 96 and 98 which extend from laterally spaced sidewalls 100 and 102, respectively. The tabs 96 and 98 are bent over and crimped against the cover plate 94 to form the nozzle body. The cover plate 94 cooperates with the generally planar support portion of the base 92 to form a nozzle passage 104.

Figure 8:
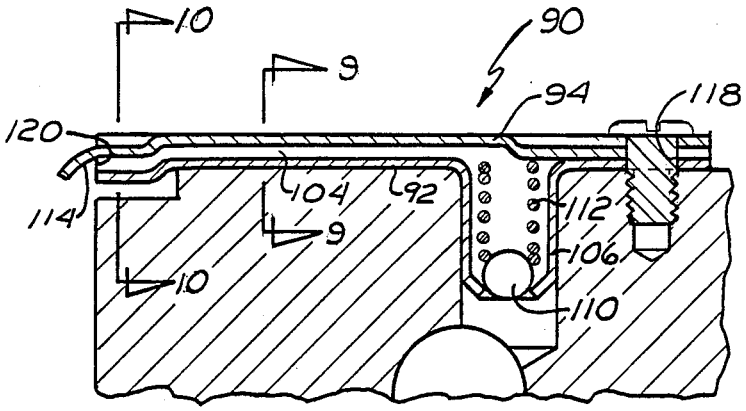
FIG. 8 is a longitudinal sectional view of a fourth embodiment of a piston cooling nozzle in accordance with the present invention, said nozzle being illustrated as mounted to a portion of the engine crankcase.

The housing base 92 is shaped to form a well 106 having an inlet opening 108. The well 106 receives a check valve assembly comprising a ball valve 110 and a spring 112 which biases the ball valve 110 against an interior well seat for closing the opening 108. The valve 110 and the spring 112 are captured between the cover plate 92 and the housing base 94 as best illustrated in FIG. 8.

The forward nose portion of the cover plate is bent or curved to form a deflector 114. It should be appreciated that the cover plate has a concave or arc-shaped section which partially defines the nozzle passage 104. The passage 104 leads from the inlet of the well to the formed nozzle orifice 120 defined between the cover plate 94 and the base plate 92 adjacent to the deflector 114. To better control the shape of the deflector 114, the contoured-shaped portions which define the nozzle passage 104 are formed in the housing base 94 at the nozzle end portion adjacent to the deflector 114 and nozzle orifice 120. An aperture 118 formed in the nozzle is adapted to receive a fastener for mounting the nozzle to the engine block 134 as previously described relative to nozzle 10.

Figure 12:
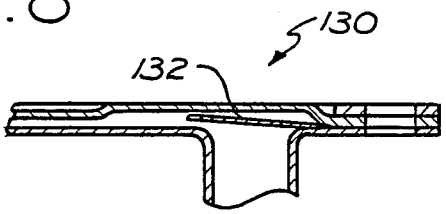
FIG. 12 is a fragmentary sectional view of a fifth embodiment of a piston cooling nozzle in accordance with the present invention.
Figure 11:
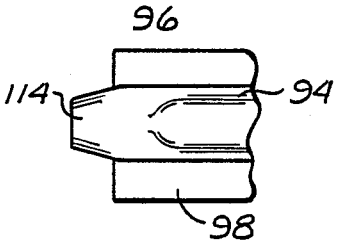
FIG. 11 is an enlarged fragmentary top view of an end portion of the piston cooling nozzle of FIG. 8.
Figure 9:
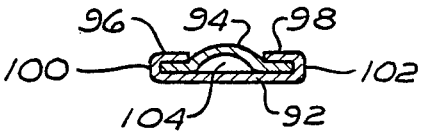
FIG. 9 is a sectional view of the piston cooling nozzle taken along the line 9—9 of FIG. 8.
Figure 10:
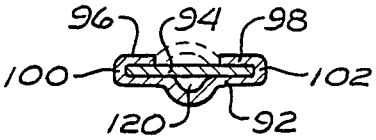
FIG. 10 is a sectional view of the piston cooling nozzle taken along the line 10—10 of FIG. 8.

With reference to FIG. 12, another embodiment of a piston cooling nozzle designated generally by the numeral 130 employs a leaf spring 132 in place of the previously described check valve assembly. The leaf spring 132 is positioned between opposing planar portions of the housing and the cover plate, and is secured in position by the folding over of the retaining tabs of the housing as previously described for nozzle 90. It should be appreciated that in some embodiments the retaining structures may integrally extend from the cover plate and be bent over the housing rather than the retaining structures extending from the housing sidewalls as described previously.

For some applications (not illustrated), neither a check valve assembly nor a leaf spring are required. A flow path is continuously defined between the nozzle inlet opening and the outlet orifice.

Figure 15:
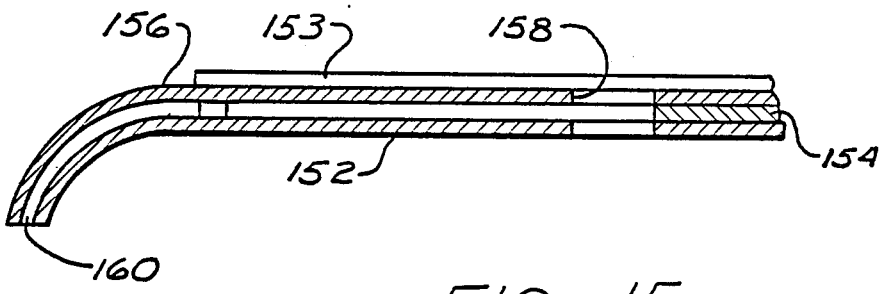
FIG. 15 is a sectional view of a sixth embodiment of a piston cooling nozzle in accordance with the present invention.
Figure 16:
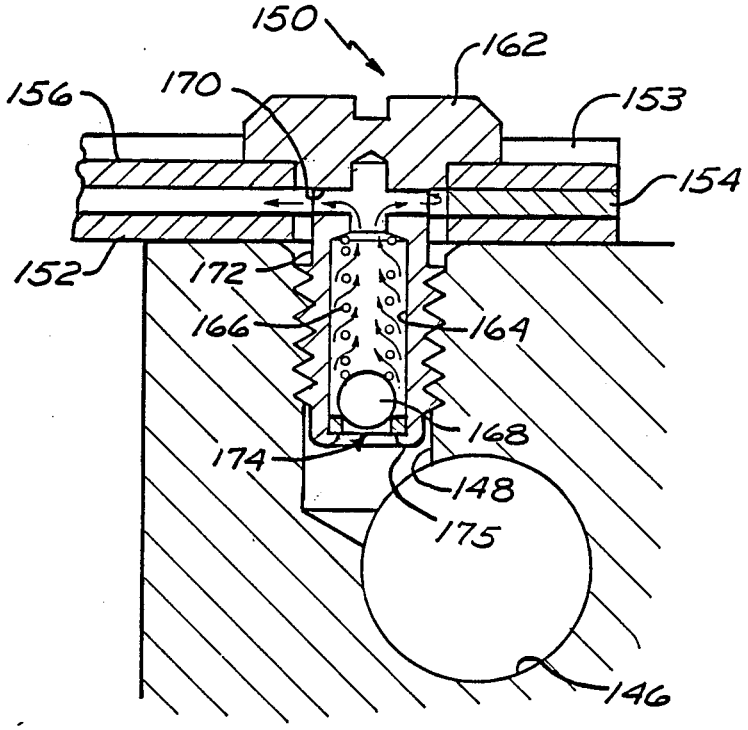
FIG. 16 is a fragmentary sectional view of the piston cooling nozzle of FIG. 15 said nozzle being illustrated as mounted to a portion of the engine crankcase.

With reference to FIGS. 15 and 16, another embodiment of a piston cooling nozzle is designated generally by the numeral 150. Oil spray nozzle 150 is suitable for applications where there is little existing room to accommodate the nozzle. Nozzle 150 includes a sheet metal nozzle base 152, an intermediate passage plate 154, and a cover 156. The base plate is folded around the passage plate and over the cover to form a retaining flange 153 as previously described. The assembled plates are bent or rounded to form a nozzle head, terminating in a nozzle orifice 160. An aperture 158 extends through the assembled plates.

With reference to FIG. 16, nozzle 150 is a highly compact nozzle for applications where there is insufficient clearance to incorporate a separately spaced check valve extension and a fastener for fastening the nozzle in position. The oil gallery 146 connects via a bore 148 for receiving a threaded fastener 162. The fastener 162 functions to both secure the nozzle in position and to house the nozzle check valve assembly. Fastener 162 includes a longitudinal bore 164 and a diametral bore 170 which opens through bore 164 near the top head portion of the fastener. The fastener and the adjacent portions of the nozzle aperture 158 cooperate to form an annulus 172 so that a passageway may be formed communicating from the oil gallery through bore 148, bore 164, bore 170 and annulus 172 for fluid communication through the nozzle passage and out the nozzle orifice 160. A threaded surface anchors the nozzle to the engine. A spring 166 biases a ball valve 168 which is secured by a press-fit retainer ring 174. The retainer ring 174 is secured into position to retain the spring/ball valve assembly within the bore 164 by crimping material 175 from the fastener 162 over the edge of the retaining ring 174. The retainer ring also functions as the valve seat for the ball valve 168. It will be appreciated that the foregoing nozzle 150 is highly compact due to the integration of the inlet check valve assembly with the mounting fastener for the nozzle.

The oil spray nozzles 10, 90, 130, and 150 as previously described, may be formed in a relatively efficient low-cost construction and assembly process to form a sandwich-type nozzle construction which has a compact low profile while also providing a suitable nozzle spray pattern for cooling the piston crown.

The housing components for the described nozzles may be assembled by a process wherein welding, brazing or similar methods are not required. The cooperative clamping engagement of the housing components is sufficient to maintain the components in assembled relationship and to seal the nozzle passageways. In one embodiment of the oil spray nozzle 10, the assembled housing 30 has a thickness which ranges from approximately 0.110 to 0.120 inches and a lateral width of approximately 0.60 inches with a length of approximately 1.5 inches. The diameter of the well opening 43 is approximately 0.28 inches, and the maximum width of the nozzle passage 48 is approximately 0.12 inches. The dimensions of opening 43 and passage 48 may be considerably different for a given engine application. In one embodiment of nozzle 90, the assembled housing has a thickness which ranges from approximately 0.085 to 0.108 inches.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A nozzle assembly for cooling the crown of a piston in an internal combustion engine comprising:

housing means having a first nozzle end and an opposing second end and forming a transversely protruding inlet well defining an inlet opening intermediate said nozzle end and said second end and comprising a pair of laterally spaced sidewalls;

cover plate means received between said sidewalls and secured to said housing means by folded extensions of said sidewalls, said cover plate means cooperating with said housing means to define a nozzle passageway extending from said well to a nozzle orifice at said nozzle end at least partially defined by said cover plate means and said housing means; and check valve means comprising a valve member and a spring received in said well and captured between said housing means and said cover plate means, said valve member being biasable by said spring to prevent the passage of fluid through said passageway when the pressure of said fluid is below a pre-established threshold, said valve member being displaceable to permit the passage of fluid through said passageway for injection through said orifice.

2. The nozzle assembly of claim 1 further comprising intermediate plate means disposed between said housing means and said cover plate means in a sandwich-like fashion, said intermediate plate means partially defining said nozzle passageway.

3. The nozzle assembly of claim 1 wherein said housing means and said cover plate means further define a transversely extending fastener aperture.

4. The nozzle assembly of claim 1 wherein said nozzle passageway extends generally linearly in a first direction and generally linearly in a second direction, said second direction being at an angle with respect to said first direction.

5. The nozzle assembly of claim 1 wherein each said housing means and said cover plate means has a generally bent leg-type configuration.

6. The nozzle assembly of claim 1 wherein said housing means and said cover plate means have a tapered nose-like shape at said nozzle end.

7. The nozzle assembly of claim 1 wherein said spring comprises spaced helical coils and said spring is positioned so that said spring functions as a filter to the passage of fluid between said inlet opening and said orifice.

8. The nozzle assembly of claim 7 wherein said intermediate plate means comprises means for locating said spring to provide a fluid flow path from generally radially exteriorly of said spring through the central longitudinal axis of said spring and through the end portion of said spring to said nozzle passageway.

9. The nozzle of claim 1 wherein said cover plate and said housing means comprise an array of projections which cooperate to define an internal edge filter in said nozzle passageway.

10. A nozzle assembly for cooling the crown of a piston in an internal combustion engine comprising:

housing means having a first nozzle end and an opposing second end and integrally forming a transversely protruding inlet well defining an inlet opening intermediate said nozzle end and said second end;

cover plate means secured to said housing means, said cover plate means cooperating with said housing means to define a nozzle passageway and a nozzle orifice at said nozzle end, said passageway extending from said well to said orifice;

retaining flanges integrally extending from one of said housing means and said cover plate means and being bent around and against said other of said housing means and said cover plate means to secure said housing means and cover plate means in assembled relationship; and valve means comprising a valve member interposed between the inlet opening and said orifice and captured between said housing means and said cover plate means to interrupt the passage of fluid from said inlet opening to said nozzle orifice when said fluid has a pressure below a pre-established threshold.

11. The nozzle assembly of claim 10 wherein said valve means comprises a leaf spring which is anchored at one end between said housing means and said cover plate means.

12. The nozzle assembly of claim 10 wherein said cover plate means has an arcuate cross section and said housing means has a planar portion which cooperate to define said fluid passageway of said nozzle.

13. The nozzle assembly of claim 10 further comprising means defining an aperture in said nozzle assembly between said well and said second end.

14. The nozzle assembly of claim 10 wherein the cover plate means has a terminus which is rounded to define a deflector adjacent to the nozzle orifice.

15. The nozzle assembly of claim 10 further comprising filter means comprising means defining an edge filter interposed in said passageway for preventing the passage to said nozzle orifice of particulate matter which exceeds a pre-established dimension.

16. A nozzle assembly for cooling the crown of a piston in an internal combustion engine comprising:

housing means having a first nozzle end and an opposing second end and integrally forming a transversely protruding inlet well defining an inlet opening intermediate said nozzle end and said second end;

cover plate means secured to said housing means, said cover plate means cooperating with said housing means to define a nozzle passageway and a restricted nozzle orifice at said nozzle end, said passageway extending from said well to said orifice; and retaining flanges integrally extending from one of said housing means and said cover plate means and being bent around and against said other of said housing means and said cover plate means to secure said housing means and cover plate means in assembled relationship.

17. The nozzle assembly of claim 16 further comprising filter means comprising means defining a restricted portion of said passageway for preventing the passage to said nozzle orifice of particulate matter which exceeds a pre-established dimension.

18. A nozzle assembly for cooling the crown of a piston in an internal combustion engine comprising:

housing means having a first nozzle end and an opposing second end;

cover plate means secured to said housing means, said cover plate means cooperating with said housing means to define a nozzle passageway and a nozzle orifice at said nozzle end, said housing means and cover plate means further defining an aperture between said first and second ends, said aperture communicating with said passageway;

retaining flange means integrally extending from one of said housing means and said cover plate means and being bent around and against said other of said housing means and said cover plate means to secure said housing means and cover plate means in assembled relationship;

fastener means receivable in said aperture for fastening said nozzle assembly in position to said engine, said fastener means defining a longitudinal bore which communicates with said passageway; and valve means comprising means defining a seat and a valve member and a spring received in said bore for selectively preventing the passage of fluid through said seat when said fluid has a pressure below a pre-established threshold.

19. The nozzle assembly of claim 18 wherein said seat is defined by retainer ring which also retains the valve member and spring within the bore.

20. The nozzle assembly of claim 18 wherein said housing means and cover plate means are bent into a curvilinear configuration with the passageway portion adjacent to said orifice extending generally parallel to said fastener bore.

* * * * *